US007275837B1

(12) United States Patent
Pusha

(10) Patent No.: US 7,275,837 B1
(45) Date of Patent: Oct. 2, 2007

(54) CAKE SHROUD

(76) Inventor: Eartha Pusha, 8550 Touchton Rd., Jacksonville, FL (US) 32246

( * ) Notice: Subject to any disclaimer, the term of this patent is extended or adjusted under 35 U.S.C. 154(b) by 0 days.

(21) Appl. No.: 11/243,552

(22) Filed: Oct. 5, 2005

(51) Int. Cl.
*F21V 33/00* (2006.01)

(52) U.S. Cl. ..... 362/154; 362/458

(58) Field of Classification Search ..... 362/154, 362/234

See application file for complete search history.

(56) References Cited

U.S. PATENT DOCUMENTS 2,238,559 A * 4/1941 Farley ..... 160/124
4,295,482 A 10/1981 McMullen
4,729,137 A 3/1988 Denney
4,793,266 A 12/1988 Napolitano et al.
5,572,936 A * 11/1996 Chroniger ..... 108/94
5,878,671 A 3/1999 Kehl
6,015,004 A 1/2000 Harkinson
6,170,961 B1 1/2001 Knoch
6,210,015 B1 4/2001 Ross
6,491,516 B1 * 12/2002 Tal et al. ..... 431/253
6,685,344 B1 * 2/2004 Lin ..... 362/352
2006/0078838 A1 * 4/2006 McLemore ..... 431/253
2006/0130677 A1 * 6/2006 Chou ..... 99/645
2006/0169690 A1 * 8/2006 Rothschild et al. ..... 220/7

* cited by examiner

*Primary Examiner*—Renee Luebke
*Assistant Examiner*—Evan Dzierzynski
(74) *Attorney, Agent, or Firm*—Lawrence J. Gibney, Jr.

(57) ABSTRACT

This is a shroud for a cake in which a cake can be covered and then uncovered to add panache to any banquet or wedding. A means to illuminate the area around the device will also be provided.

11 Claims, 4 Drawing Sheets

CAKE SHROUD

CROSS REFERENCES TO RELATED APPLICATIONS

Not Applicable

STATEMENT REGARDING FEDERALLY SPONSORED RESEARCH

Applicable

REFERENCE TO APPENDIX

Not Applicable

BACKGROUND OF THE INVENTION

A. Field of the Invention

This relates to designing a cover for a cake. This would be particularly important in banquets or weddings where the cake or other food is a center piece.

B. Prior Art

There are many other prior art references to cakes and cake coverings. Representative examples of these include Knoch U.S. Pat. No. 6,170,961, Ross U.S. Pat. No. 6,210,015, and Napolitanal U.S. Pat. No. 4,793,266.

The Knoch patent is an illuminating cake stand without a cover and the Ross and Napolitanal are cake decorating stands.

In the present application this is a cake stand which can be illuminated but also have a covering which moves up and down a series of stanchions or supports to unveil the cake to the audience.

BRIEF SUMMARY OF THE INVENTION

This is a device, which is a covering for a cake. It will have a base, several support stanchions or guides and a top. Between the top of the device and the base will be the covering. The covering may consist of a variety of different materials although a thin cotton or shear material is probably preferred for the desired effect.

The cake rests on the top of the base underneath the top of the device. Holes in the top of the base and bottom of the top are provided to insert the support stanchions. Several support stanchions will be used to support the top and provide the enclosure for the cake or other item that will be covered.

The shroud material would be positioned in such a fashion to cover the entire space between the top and bottom of the device. A means to allow the shroud material to travel between the base of the device and the top would be provided. A variety of means to enable the shroud material to move up and down the stanchions is contemplated.

The thin shroud material will travel up and down in a generally vertical direction along the support stanchions on this device. The means to enable the shroud material to travel may be operated locally or remotely.

This device will enable the cake to be unveiled at the appropriate time for the viewing audience. A method to illuminate the device as well as a source of illumination will also be included.

It is an object of this device to make a cake a centerpiece of a particular event such as a wedding reception or other gathering.

DETAILED DESCRIPTION OF THE EMBODIMENTS

Figure 1:
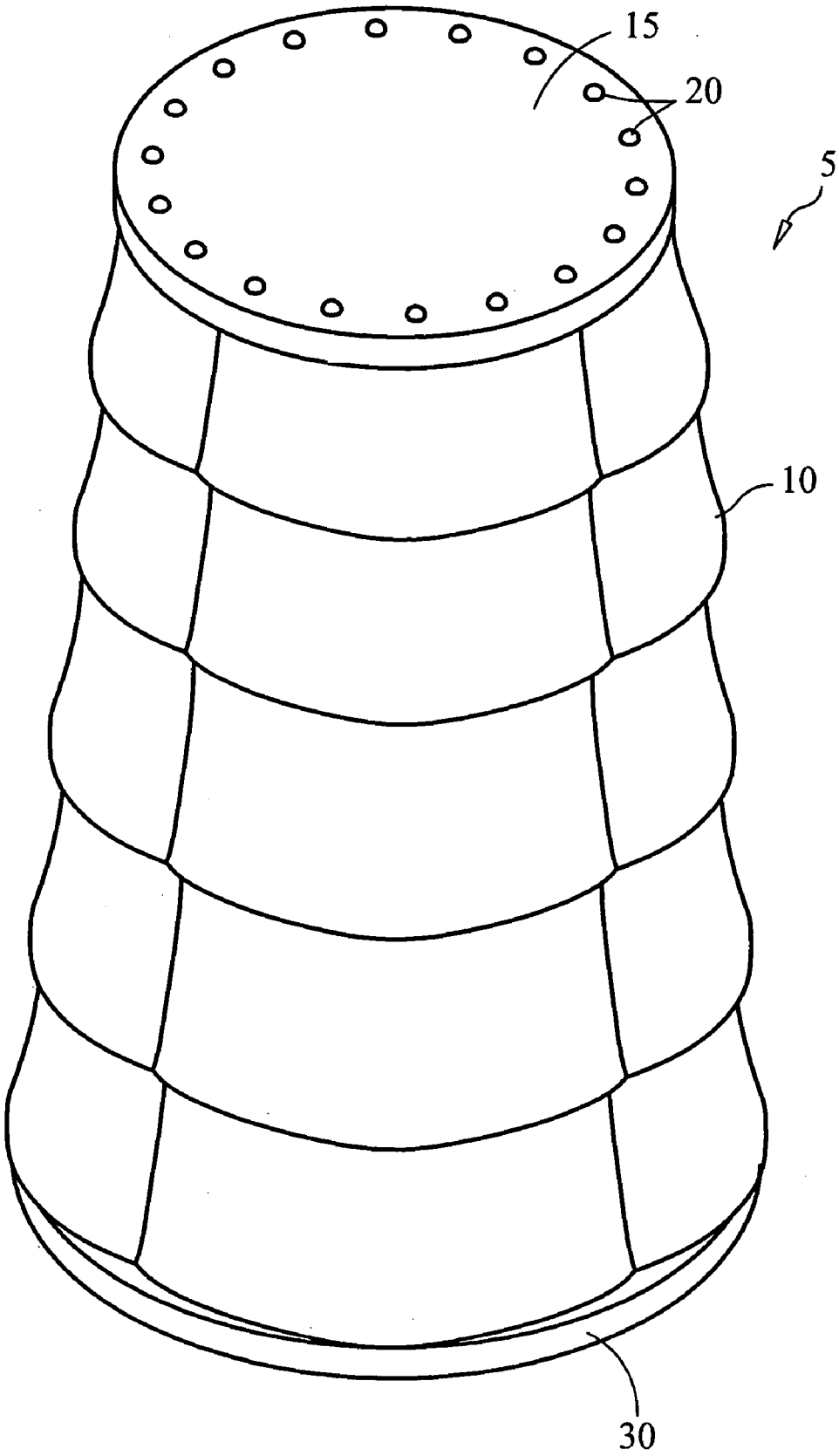
FIG. 1 is a front view of the device with the shroud in the down position.

This device 5 is a cake shroud. It will be comprised of a base 30 and a top 15. Between the top 15 and the base 30 will be a plurality of support stanchions 25 to support the top 15. On end of the stanchion 25 will be inserted into a hole in the base 30 and the other end will be inserted into a hole on the bottom surface of the top 15. It is contemplated and depicted in the drawings that both the top 15 and the base 30 will be circular to conform to the general shape of a wedding cake. Other shapes such as a square or rectangle may also be used. FIG. 1

Additionally, there will be a means of illumination or source of lighting 20 around the top 15 as well as the base 30. The source of lighting 20 may be small incandescent bulbs or may be a plurality of LEDs. Because excessive heat is not desired, LEDs would probably be the preferred choice although there are many different types of lighting sources. Appropriate wiring and a power source, which can be alternating current or battery power will be provided to operate the means of illumination. FIG. 1,2

The means to illuminate the base 30 and the top 15 will be placed around the perimeter of the base 30 and the top 15. A power source for the source of illumination will also be provided. The power source could be alternating current or a plurality of batteries. The lighting may also be regulated using a rheostat or dimmer to allow the user of the device to adjust the amount of light on the device, as desired.

Figure 2:
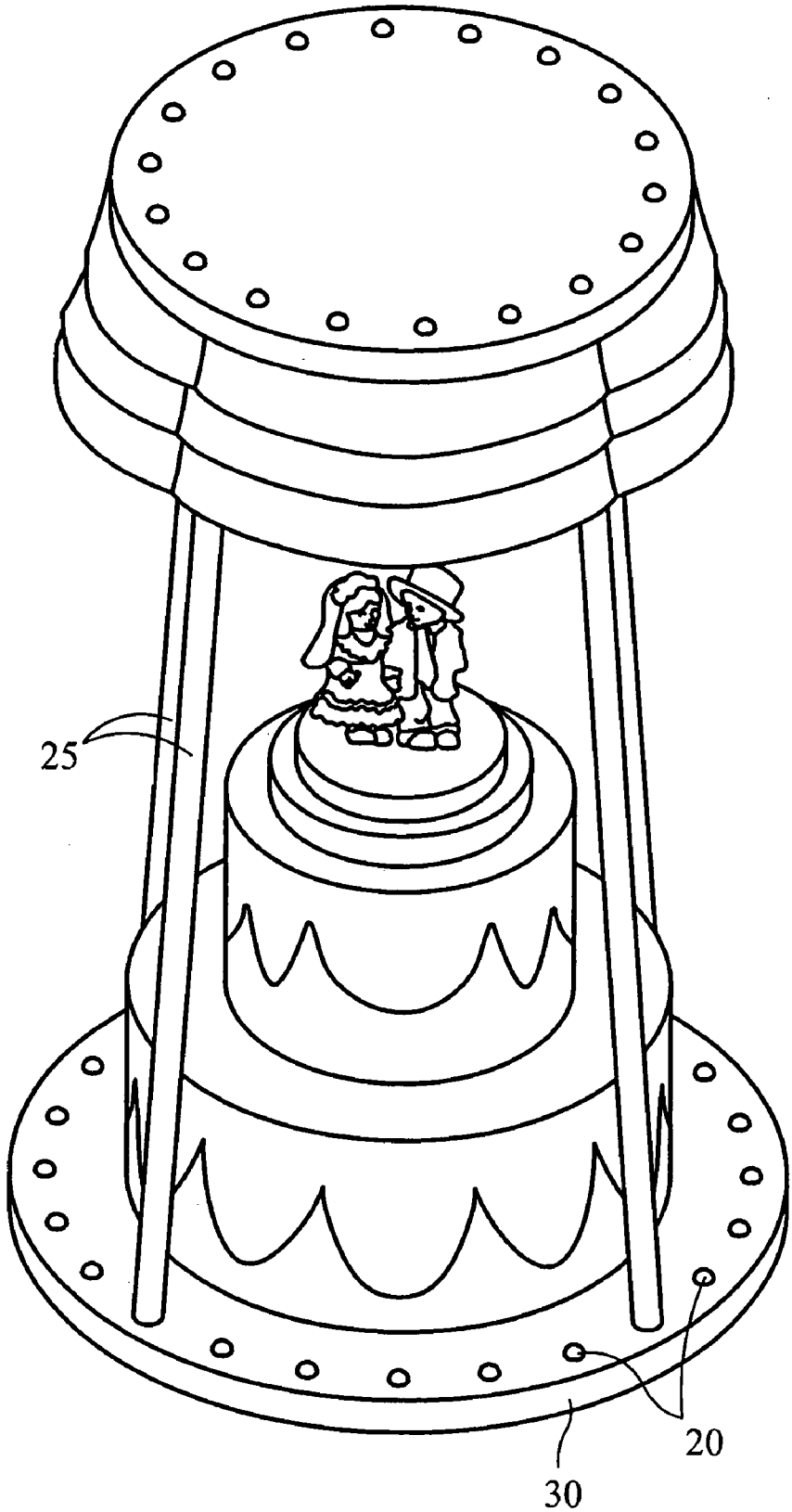
FIG. 2 is a front view of the device with the shroud in the up position.

The base 30, top 15 and support stanchions 25 will likely be constructed of plastic or some other lightweight, durable material. The support stanchions 25 will fit into designated holes on the base 30 as well as the top 15. The holes are not depicted but are indicated by the drawings in FIG. 2. It is contemplated that four stanchions will be used to insure that the top 15 is secured to the device 5.

Before the presentation of the cake the shroud material 10 will be in the down position or shielding from view the interior contents of the device 5. FIG. 1 When the shroud material 10 moves from the base 30 to the top 15, the interior contents are revealed, in this case, a cake.

This device will provide a certain desired amount of panache to a significant event such as a wedding or banquet. Although a cake is depicted in the drawings, it may also be used for other food or to display non-food items as well.

Figure 3:
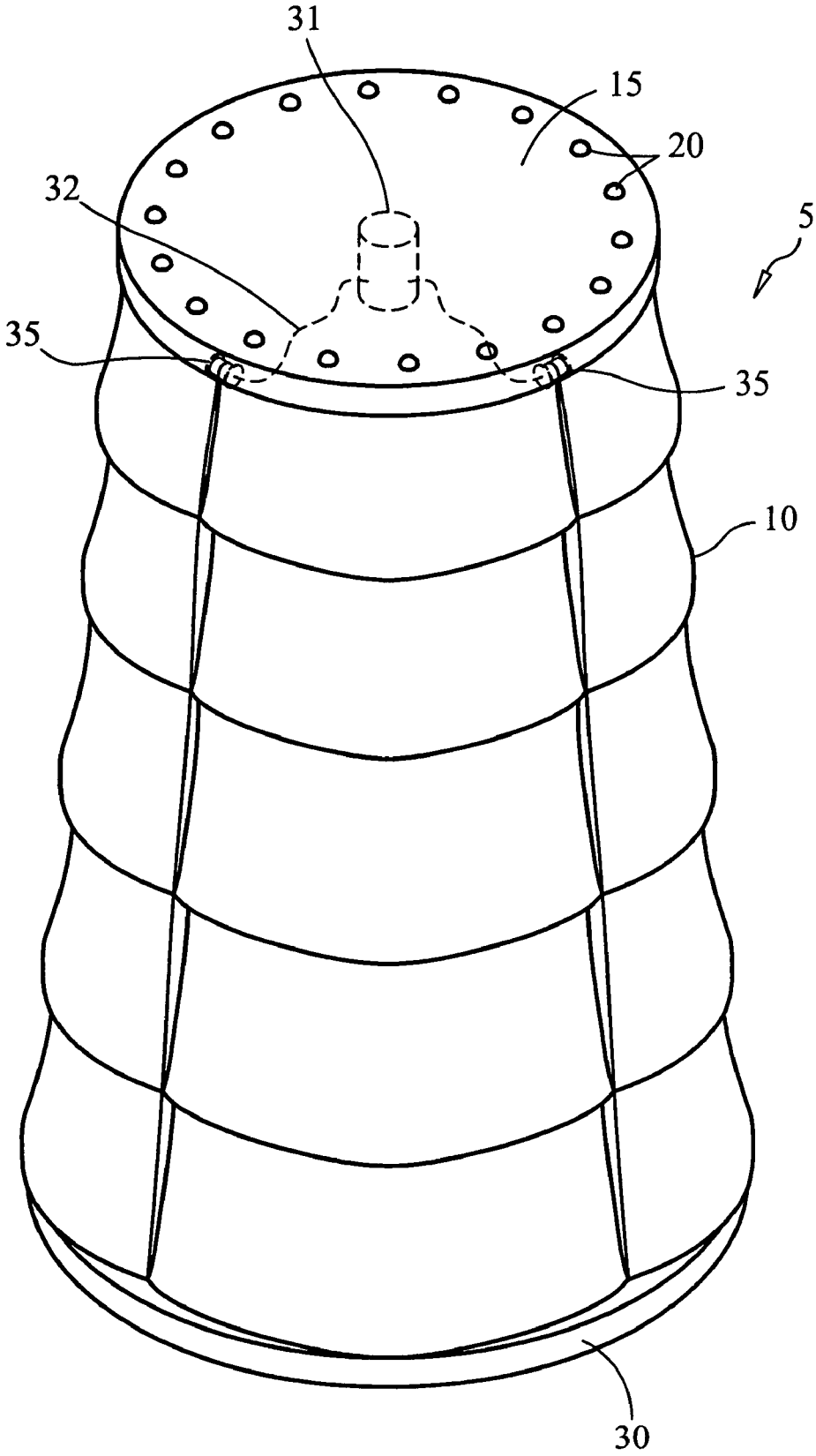
FIG. 3 is a representation of the guide mechanism and remote control motor.
Figure 4:
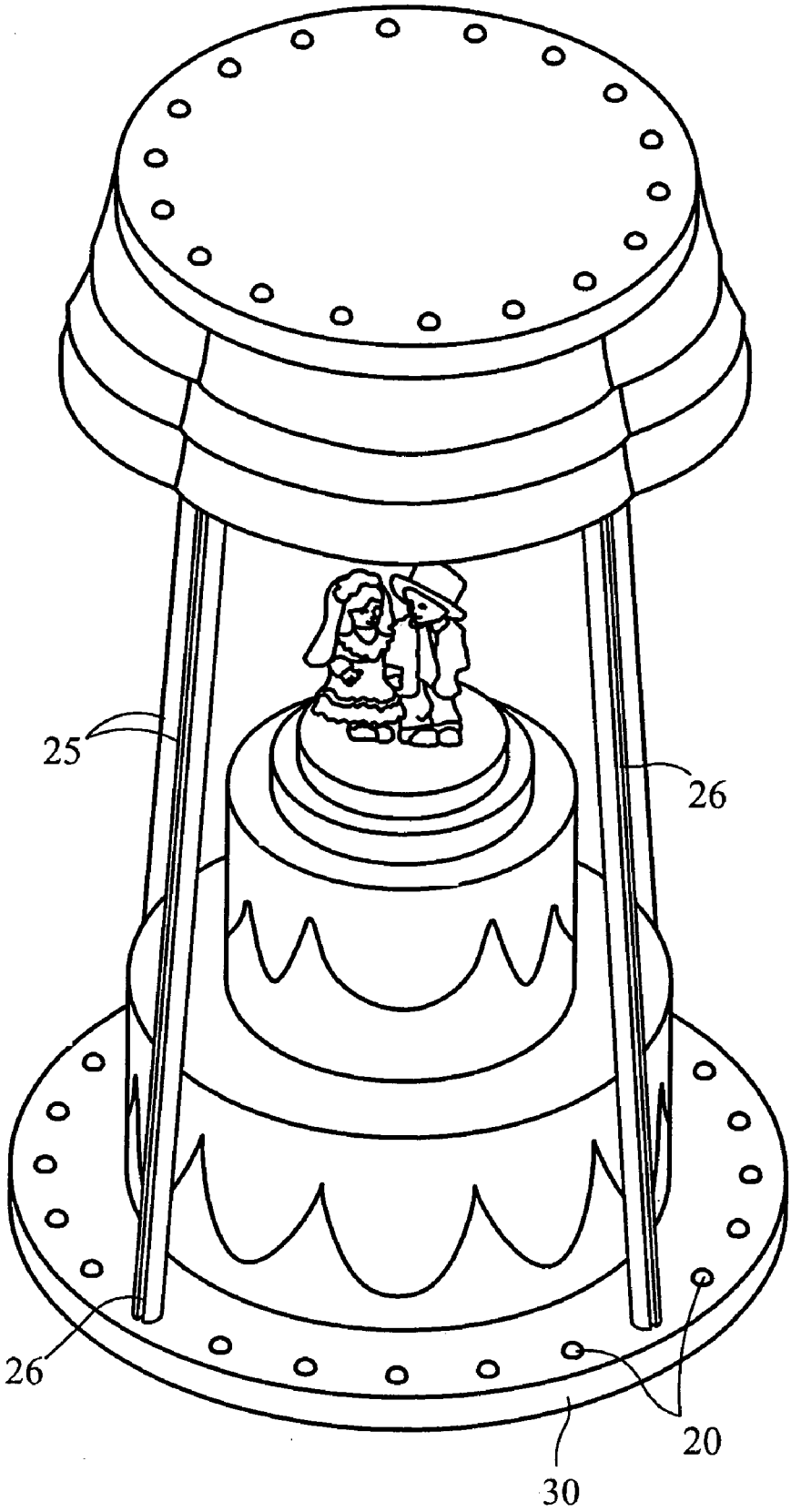
FIG. 4 is a representation of one embodiment to move the shroud material up and down the stanchions.

In order to move the shroud material 10 from the bottom of the base 30 to the top 15 several different means are anticipated. FIG. 3,4 Appropriate wiring and a power source, which can be alternating current or battery, will be provided to operate the means to move the shroud material.

The first embodiment involves using a small electrical motor 31, string 32 and a series of pulleys 35. FIG. 3 The string 32 would be looped around both ends of the shroud 10 and as the electrical motor 31 winds a spool the shroud material 10 is pulled in an upward direction. The electrical motor is shown placed on the underside of the top 15 but may be placed on other locations on this device.

A second embodiment is to place grooves 26 in the stanchions and corresponding male ends on the shroud to ensure uniform and even movement of the shroud material 10 as it moves along the stanchions.

A third embodiment, which is not depicted, may include a plurality of rings around the shroud material at certain intervals.

The small electrical motor 31, string 32 and pulleys 35 would be necessary to allow the shroud material to move up and down along the stanchions in a uniform, even manner. The specific movement may be accomplished either locally by an on/off switch (not depicted) or remotely using a remote control device. Both the on/off switch and the remote control device would control the operation of the electrical motor and the source of illumination.

Additionally, because the cake is eventually to be consumed it is anticipated that the stanchions and top may be removed easily by pulling the stanchions out of the holes for the support.

The invention claimed is:

1. This device is a cake shroud which is comprised of:
a. base;
wherein the base is of a predetermined thickness;
wherein the base is annular;
wherein the base has holes of a predetermined size in which to insert a plurality of stanchions;
b. stanchion;
wherein each of the stanchions have a first end and a second end;
wherein each of the stanchions is connected to a hole in the base and a corresponding hole in a top member;
wherein a plurality of stanchions is used;
c. a top member;
wherein the top member is of a predetermined thickness;
wherein the top member is annular;
wherein the top has holes on one side of a predetermined size in which to insert the stanchions;
wherein the top member is supported by the stanchions when the device is assembled;
d. a source of illumination;
wherein a source of illumination is provided;
wherein a plurality of the source of illumination is provided on the base;
wherein a plurality of the source of illumination is provided on the top member;
e. power source;
wherein a power source is provided for the means to illuminate;
wherein the power source operates a means to move a shroud;
f. a shroud;
wherein a shroud is provided;
said shroud extends from the top member the base;
wherein the shroud moves along the outside edge of the stanchion;
wherein a means to connect the shroud to a means to move the shroud is provided;
g. means of connection for the shroud; material;
wherein a means to connect the shroud to the device is provided;
h. a means to move the shroud;
wherein a means to move the shroud is provided;
said means to move the shroud is connected to the shroud.

2. The device as described in claim 1 wherein the power source is a plurality of batteries.

3. The device as described in claim 1 wherein the power source is alternating current.

4. The device as described in claim 1 wherein the source of illumination is a plurality of incandescent bulbs.

5. The device as described in claim 1 wherein the source of illumination is a plurality of LEDs.

6. The device as described in claim 1 wherein the means to move the shroud material is performed locally.

7. The device as described in claim 1 wherein the means to move the shroud is performed remotely.

8. The device as described in claim 1 wherein the source of illumination can be adjusted.

9. The device as described in claim 1 wherein the means to move the shroud is further comprised of a small electrical motor, a series of strings and a plurality of pulleys;
said strings are connected to a portion of the electrical motor and guided through the plurality of pulleys;
wherein a means to connect the strings to the shroud is provided.

10. The device as described in claim 9 wherein the means to connect the strings to the shroud is a plurality of rings around the shroud.

11. The device as described in claim 9 wherein the means to connect the shroud to the stanchions is a series of grooves with appropriate male ends on the shroud.

* * * * *